US008747996B2

(12) United States Patent
Deetz

(10) Patent No.: US 8,747,996 B2
(45) Date of Patent: Jun. 10, 2014

(54) MAGNETIC GRAPHIC WALL SYSTEM

(76) Inventor: Dayton Joseph Deetz, Mendon, MA (US)

( * ) Notice: Subject to any disclaimer, the term of this patent is extended or adjusted under 35 U.S.C. 154(b) by 0 days.

(21) Appl. No.: 12/231,766

(22) Filed: Sep. 5, 2008

(65) Prior Publication Data

US 2011/0165386 A1 Jul. 7, 2011

(51) Int. Cl.
*G09F 19/00* (2006.01)

(52) U.S. Cl.
USPC ..... 428/195.1; 428/692.1; 428/693.1; 428/900; 40/426; 40/600; 40/621; 434/430

(58) Field of Classification Search
USPC ..... 428/195.1, 692.1, 693.1, 900; 40/426, 40/600, 621; 434/430
See application file for complete search history.

(56) References Cited

U.S. PATENT DOCUMENTS

| | | | | | |
|---|---|---|---|---|---|
| 3,228,133 | A * | 1/1966 | Baermann | 40/621 |
| 3,659,353 | A * | 5/1972 | D'Agrosa | 434/73 |
| 3,716,935 | A * | 2/1973 | Friederichs | 40/621 |
| 3,755,938 | A * | 9/1973 | Bytwork | 40/530 |
| 3,942,147 | A * | 3/1976 | Josephson | 335/285 |
| 5,203,847 | A | 4/1993 | Butt | |
| 6,182,387 | B1 | 2/2001 | Duguay | |
| 6,302,363 | B1 * | 10/2001 | Olson et al. | 248/206.5 |
| 2003/0152731 | A1 | 8/2003 | Deetz et al. | |

FOREIGN PATENT DOCUMENTS

| | | | |
|---|---|---|---|
| EP | 1597717 | B1 | 11/2005 |
| JP | H0627895 | A | 2/1994 |
| JP | H0662861 | U | 9/1994 |
| JP | H08123314 | A | 5/1996 |
| JP | H08272289 | A | 10/1996 |
| JP | H0916052 | A | 6/1997 |
| JP | 2000122585 | A | 4/2000 |
| WO | 2004075145 | A1 | 9/2004 |

* cited by examiner

*Primary Examiner* — Gerard Higgins
(74) *Attorney, Agent, or Firm* — St. Onge Steward Johnston & Reens LLC

(57) ABSTRACT

The practical application of incorporating magnetic receptive printing media coupled with the use of an underlying specifically referenced magnet allows the multi layering of magnetic media while maintaining the reference of position on said surface. This is achieved by aligning the polarity lines to the benefit of the intended design while fabricating the first layer to receive the second or subsequent layers to interact with the intended design.

4 Claims, 1 Drawing Sheet

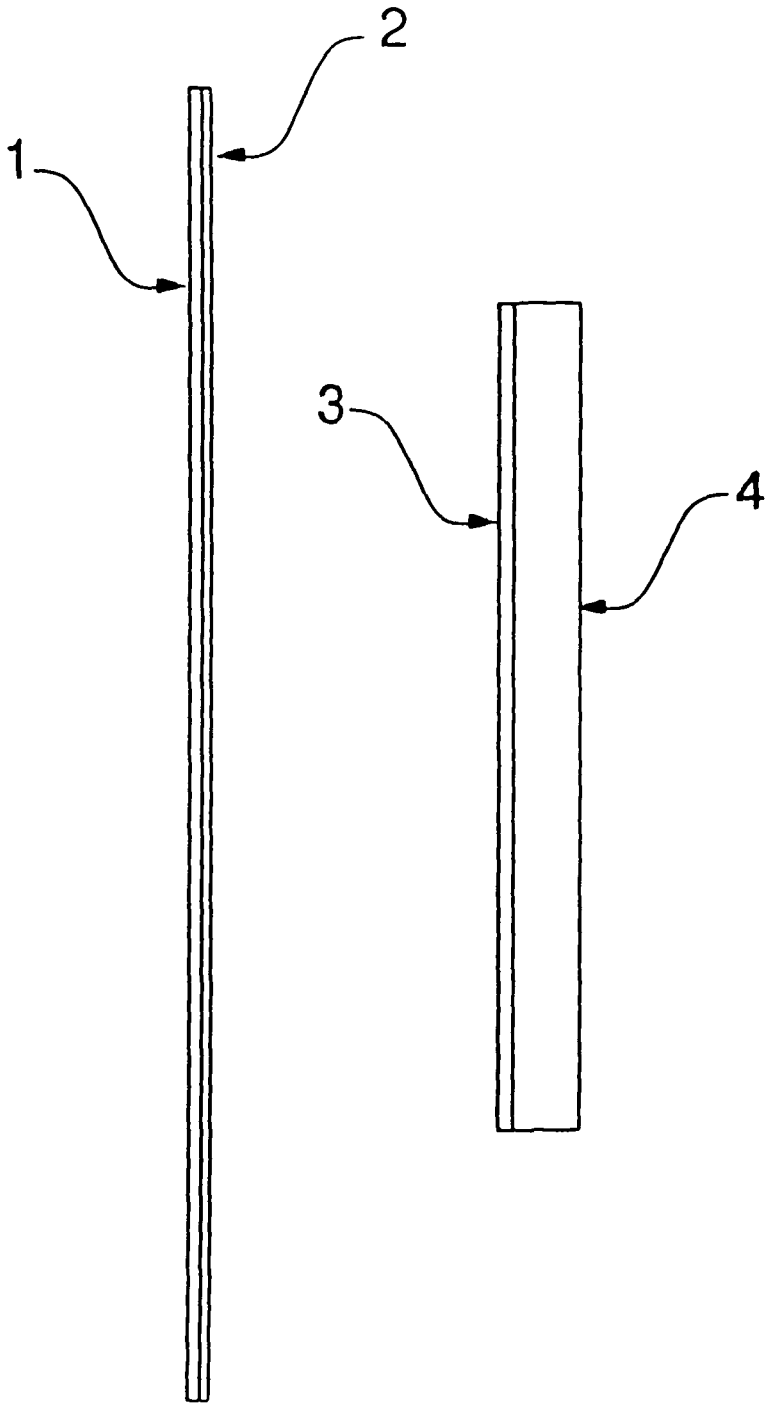
2
1
3
4

MAGNETIC GRAPHIC WALL SYSTEM

TECHNICAL FIELD OF THE INVENTION

This invention incorporates the use of our patented printing media combined with a magnetized sub surface with alternating polarity lines. This allows the application of a magnetic receptive (changeable surface) and secondly the layering of such surfaces including other magnetized media with corresponding polarity lines. When this system is employed you can simply mount all types of graphics and other objects affixed with the magnet and they will lock into place predetermined. This ensures all objects being level and referenced in the place desired over the changeable surface. Improvements can be made by utilizing Fe3O4 (Magnetite) from the Spinel group in size distribution that creates a fully filled surface. Incorporating a range of particle sizes that lends itself to leveling out to a smoother finished surface. We have developed a new standard of critical size requirement that plays out as follows. Using a preferred size of particle for your given requirement. It is important to maintain a range of what we call the 20-80 7×ps (seven times particle size multiplier). In short this is a separation of media that keeps all particles employed having a distribution of 20% through 80% of the particles that fall in a specified size range, for example, using particle sizes from 4 to 28 microns having 4 microns and smaller at the 20% and 28 microns and smaller at 80% gives you a size range capable of creating an almost solidly filled surface. All spaces between each of the larger particle sizes are filled in with each smaller sized particle until you have utilized your range of particles. This makes for a coating with a higher particulate load in a dry film thickness of a thinner standing than using standard screened particles with narrow ranges. Fe3O4 is one of the most naturally magnetic substances on earth and will build a magnetic field over time when exposed to said field. This will allow the use of less material when coating a substrate yielding a thinner finished sheet and develop a stronger magnetic bond over time.

BACKGROUND OF THE INVENTION

We have developed numerous magnetic receptive products from paints to papers and this product line incorporates all products to produce a fully dynamic interactive wall system. The need for an easy to use magnetic system that has a neat presentation is paramount. By incorporating a layer of magnet, the first surface, then applying a second layer of magnetic receptive media you can place a third layer with the same magnet as the first layer having the same polarity lines in reference with each other. This will allow one to design the connection of the polarity lines to be beneficial to ones design intents.

This will work for entire wall systems ideal for Retail Graphics, Menu Boards, Museums, Displays, Corporate Settings and more.

Addition to Specific Specifications

When producing a sheet for certain printers it is important to have either a void of coating on the coated side such that the electronic eyes of said printers could detect the material. This can also be achieved by back printing lines or other detectable graphics on the coated side.

SUMMARY OF THE INVENTION

This system allows for an invisible hanging system on a given surface that will allow the ordinary person without a level, adhesive, tapes or any other fastening system to hang framed art work, graphics, signs, hooks, shelves and the like anywhere they desire. This is accomplished by using a multiple layering system utilizing sheet rubber magnet and magnetic receptive layers, of which some include the same sheet magnet of the first layer, to build a dynamic presentation.

EXAMPLE

The following example is presented to further illustrate and explain the present invention and should not be taken as limiting in any regard.

Example 1

0.030 rubber extruded sheet magnet with polarity lines running along the surface in a concentration of 13 lines per inch. This is applied to a wall area in a retail environment. The wallpaper is printed on the magnetic receptive films and simply rolled out on the wall using no adhesive just the magnetic force. Additional graphics are layered on top of second surface. A menu board made from, thick plastic sheet stock having the same magnet adhered to front and back surface. Menu graphics layered to front surface of menu board and all pricing and applied graphics are attached to menu board graphic with magnet of first surface.

Brief Description of the Drawing

FIG. 1 depicts a cross section of the wall system with multiple parts.

Detailed Description of the Drawing

FIG. 1 number 1 is the layer having alternating polarity lines this is typically at a 10 to 14 lines per inch, but must be a consistent spacing in all utilized layers. Number 2 is the layer of magnetic receptive printed graphic film having no specific polarity. Number 3 is the matching layer of layer 1, having the same polarity spacing as first layer. Number 4 is a layer of printed board with additional graphics mounted or printed on the outer laying surface.

The invention claimed is:

1. A magnetic wall system comprising:

a first layer, said first layer being a sheet of magnet having alternating polarity lines, a second layer, said second layer being a sheet of a magnetic receptive material having printing thereon, said second layer itself being nonmagnetic, and a third layer, said third layer being a sheet of magnet having alternating polarity lines, wherein said second layer is layered on top of said first layer, and said third layer is layered on top of said second layer, and wherein the alternating polarity lines of said third layer correspond with those of said first layer such that said third layer locks into place in reference with said first layer via said alternating polarity lines of said first layer and of said third layer.

2. The magnetic wall system of claim 1, wherein said polarity lines of said first layer and said third layer are in a concentration of 13 lines per inch.

3. The magnetic wall system of claim 1, wherein said first and third layers are rubber extruded sheet of magnet.

4. The magnetic wall system of claim 1, wherein said magnetic receptive material is magnetite.

* * * * *